United States Patent [19]

Peacock et al.

[11] Patent Number: 4,615,144

[45] Date of Patent: Oct. 7, 1986

[54] PORTABLE SKATE SHARPENER

[76] Inventors: Wally E. Peacock, 726-10th Avenue; Martin T. Carew, 3209-5th Avenue, both of Castlegar, British Columbia, Canada

[21] Appl. No.: 678,533

[22] Filed: Dec. 5, 1984

[30] Foreign Application Priority Data

Aug. 9, 1984 [CA] Canada ..... 460648

[51] Int. Cl.[4] ..... B24B 9/04

[52] U.S. Cl. ..... 51/5 D; 51/170 PT; 51/173; 51/268; 76/83

[58] Field of Search ..... 51/5 D, 170 PT, 173, 51/102, 268, 270–272, 228, 170 R, 72 R; 76/83

[56] References Cited

U.S. PATENT DOCUMENTS

| | | | |
|---|---|---|---|
| 2,835,084 | 5/1958 | Fotre | 51/170 R |
| 3,125,833 | 3/1964 | Wilde | 51/173 |
| 3,164,932 | 1/1965 | Morith | 51/170 PT |
| 3,812,626 | 5/1974 | Thompson | 51/170 PT |
| 3,881,280 | 5/1975 | Thompson | 51/102 |
| 4,109,419 | 8/1978 | Broadbent | 51/228 |
| 4,271,635 | 6/1981 | Szalay | 51/5 D |

FOREIGN PATENT DOCUMENTS

| | | | |
|---|---|---|---|
| 0480516 | 5/1953 | Italy | 51/270 |

*Primary Examiner*—Frederick R. Schmidt
*Assistant Examiner*—Robert A. Rose
*Attorney, Agent, or Firm*—Robert F. Delbridge; Arne I. Fors

[57] ABSTRACT

A portable skate sharpener has an elongated hollow main body having an electric motor adjacent one end, the electric motor having an output shaft extending in a longitudinal direction in the main body, and a grinding wheel mounted on the shaft for rotation in a plane perpendicular to the longitudinal axis of the main body. The main body has an aperture below the grinding wheel for receiving an upper edge of an upturned skate blade to enable a skate to be sharpened when held in an inverted position by holding the main body with one hand adjacent the motor end and another hand adjacent an opposite end of the main body and, while the motor is operating to rotate the grinding wheel, manually moving the sharpener in a direction transverse to its length with the skate edge in the body aperture and in engagement with the grinding wheel.

4 Claims, 5 Drawing Figures

PORTABLE SKATE SHARPENER

Figure 1:
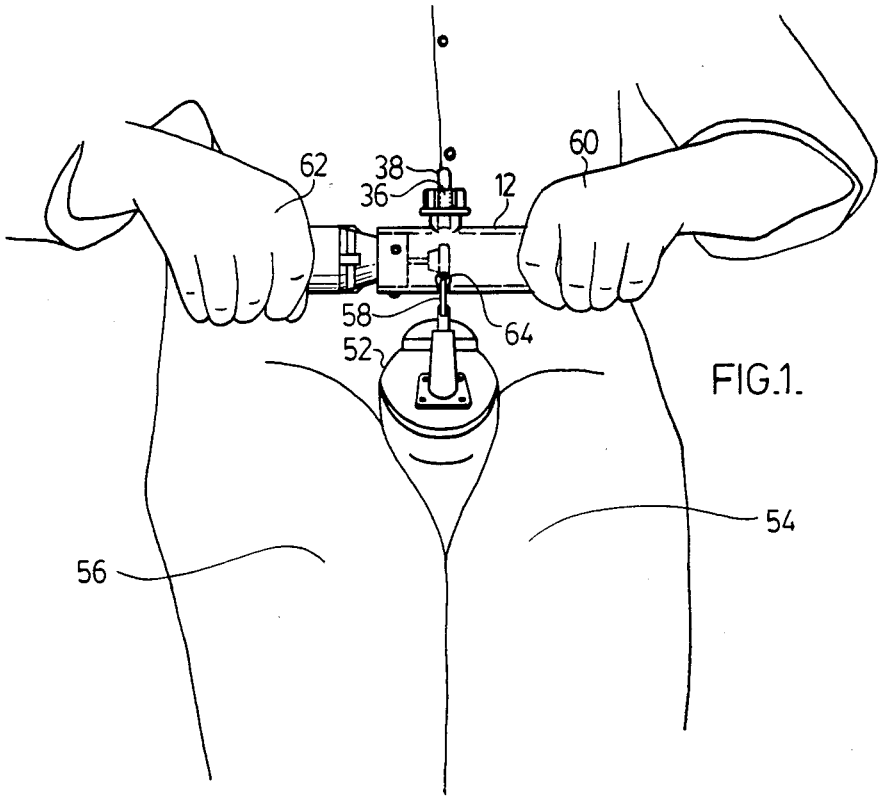

This invention relates to portable skate sharpeners.

It is well known that ice skates need frequent sharpening, whether the user be every day skaters, ice hockey players, or figures skaters. To have skates sharpened, it is usually necessary to take them to a person with the necessary sharpening equipment. Not only is this inconvenient, but the efficiency of the sharpening equipment and/or the operator is frequently less than desired. Personally-operated skate sharpeners have been previously proposed, but for various reasons have not proved to be particularly successful.

It is therefore an object of this invention to provide a skate sharpener which is not only readily portable, but which also enables skates to be efficiently sharpened by the skate owner if desired.

According to the invention, a portable skate sharpener comprises an elongated hollow main body having an electric motor adjacent one end, said electric motor having an output shaft extending in a longitudinal direction in the main body, and a grinding wheel mounted on said shaft for rotation in a plane perpendicular to the longitudinal axis of the main body, said main body having an aperture below the grinding wheel for receiving an upper edge of an upturned skate blade to enable a skate to be sharpened when held in an inverted position by holding the main body with one hand adjacent the motor end and another hand adjacent an opposite end of the main body and, while the motor is operating to rotate the grinding wheel, manually moving the sharpener in a direction transverse to its length with the skate edge in the body aperture and in engagement with the grinding wheel.

A skate sharpener in accordance with the invention is thus readily portable and also enables skates to be effectively sharpened in a hand-held operation.

The main body may comprise means for dressing the grinding wheel at a position above the grinding wheel, said dressing means comprising a plunger projecting into the main body above the grinding wheel and carrying a dressing member at its lower end, said plunger normally being resiliently urged upwardly to an inoperative position and having an upwardly projecting end manually engageable to move the plunger downwardly to cause the dresser member to engage and dress the grinding wheel while the grinding wheel is beong rotated by the electric motor. Advantageously, the electric motor is eccentrically mounted in the main body to position the grinding wheel nearer the skate blade receiving aperture.

The main body may advantageously be transparent, at least in a region adjacent the grinding wheel to enable a sharpening operation to be more readily observed.

The grinding wheel may have an outwardly curved peripheral grinding surface, with the dressing member having a complementary inwardly curved driving edge to enable a skate blade to be hollow ground.

Figure 2:
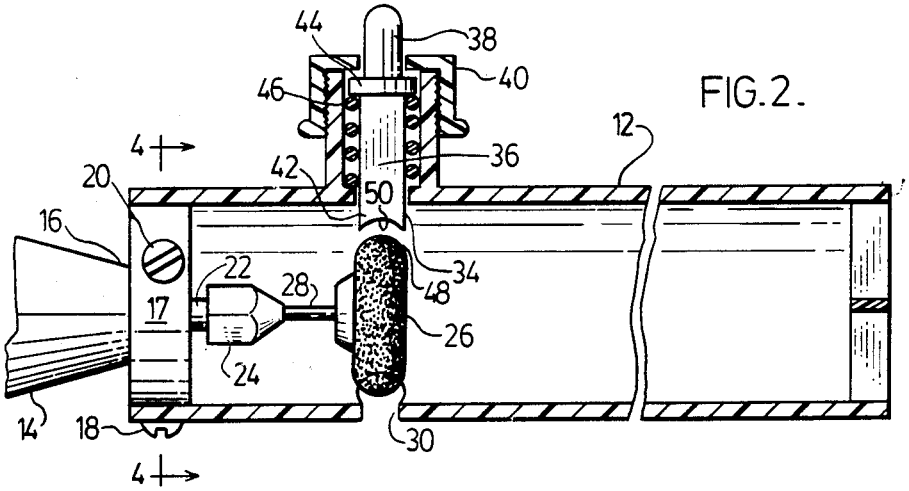
Figure 3:
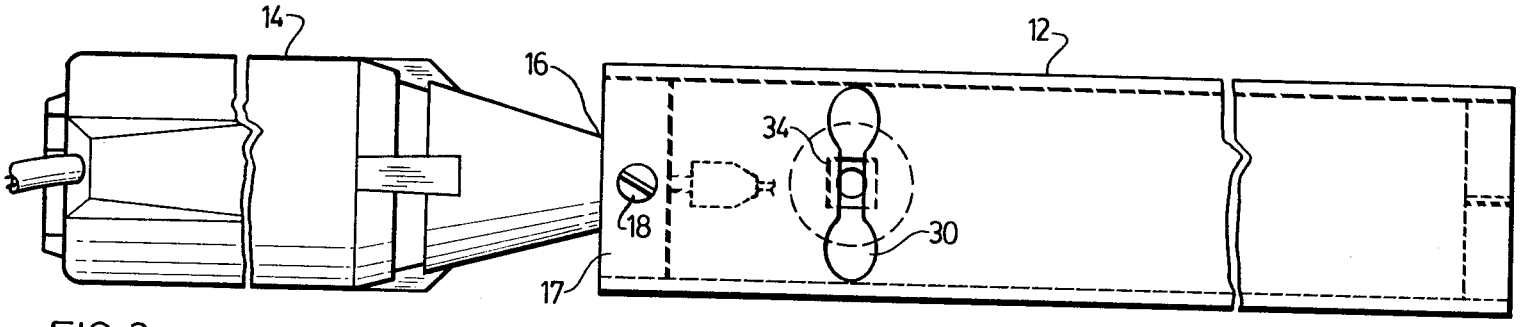
Figure 4:
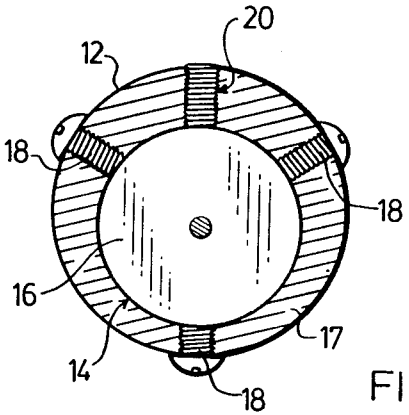
Figure 5:
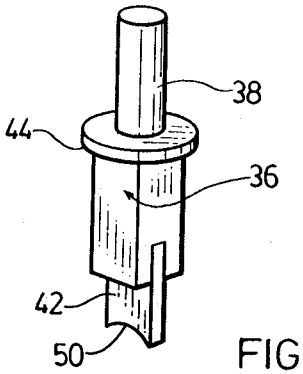

One embodiment of the invention will now be described by way of example, with reference to the accompanying drawings, of which:

FIG. 1 is a plan view showing a hand-held sharpening operation with a skate sharpener in accordance with the invention, FIG. 2 is a side view, partly in section, of the skate sharpener, FIG. 3 is a bottom view, FIG. 4 is a sectional view along the line 4—4 of FIG. 2, and FIG. 5 is a perspective view of the dresser plunger and dresser member.

Referring to the drawings, a portable skate sharpener for hand-held operation comprises a hollow cylindrical main body 12 of transparent acrylic material. Adjacent one end, an electric motor 14 has the front end 16 of its housing eccentrically mounted in the body 12 by an off-centre coupling 17 with three headed screws 18 and a set screw 20. The motor 14 has a power supply cord and plug (not shown) enabling the motor 14 to be operated from any convenient power source, and also has an output shaft 22 extending in a longitudinal direction in the body 12. The shaft 22 has a conventional chuck 24 at its outer end, and a grinding wheel 26 and shaft 28 are mounted in the chuck 24 so that the grinding wheel 26 is rotated in a plane perpendicular to the longitudinal axis of the body 12.

The body 12 has an aperture 30 of elongated dumbbell shape extending transversely below the grinding wheel 26, the centric mounting of the motor 14 positioning the grinding wheel 26 nearer the aperture 30 than the part of the body 12 above the grinding wheel 26.

The sharpener also has a dressing assembly including a hollow cylindrical guide member 32 integral with the body 12 and located above the grinding wheel 26. The body 12 has a rectangular aperture 34 within the guide member 32. A plunger 36 is mounted in the guide member 32, with an upper end 38 projecting above retaining cap 40 screwed onto the top of the guide member 32, and lower end carrying a dresser member 42 projecting into the body 12 above the grinding wheel 26. Plunger 36 has a collar 44 within the guide member 32, and a spring 46 acts between the collar 44 and the body 12 to urge the plunger 36 to an upper position in which the dresser member 42 is spaced above the grinding wheel 26. The lower portion of the plunger 36 below the collar 44 is of square cross section corresponding to that of the body aperture 34. Grinding wheel 26 has a transversely outwardly curved peripheral grinding surface 48, and the dresser member 42 has a complementary transversely inwardly curved dressing surface 50.

In use, the motor 14 is connected to a oonventional power source, and the operator sits with a skate boot 52 firmly held in an inverted position between the knees 54, 56 as shown in FIG. 1, so that the skate blade 58 is directed upwardly and extends longitudinally towards the operator's body with the motor 14 switched on to rotate the grinding wheel 26, the operator grasps the motor 14 with the left hand 60 and the opposite end of the body 12 with the right hand 62, and positions the body 12 so that the skate blade edge 64 enters tehe aperture 30. The operator then moves the sharpener to and fro in a direction transverse to its length, i.e. towards and away from the operator's body, with the grinding wheel 26 in engagement with the blade edge 64. The blade edge 64 is hollow ground i.e. is transversely inwardly curved with the grinding wheel 26 having the consequently necessary transversely outwardly curved grinding surface 48 as previously mentioned. Since the body 12 is transparent, the operation can be easily visually monitored by the operator.

At suitable times, the grind wheel 26 can be dressed by manually depressing the plunger 36, with the motor 14 in operation, to cause the dresser member 42 to engage the rotating grinding wheel 26. As also previously mentioned, the dresser member 42 has a transversely inwardly curved dressing surface 50 so as to dress the grinding wheel 26 to the correct shape for hollow grinding. In other words, the dressing surface 50 of the dresser member 42 is shaped in the same manner as the skate blade edge 64.

The advantages of the hand-held skate sharpener of the present invention will therefore be clear from the foregoing description of a preferred embodiment. In particular, it will be noted that the skate sharpener can be conveniently carried in a hockey skater's or figure skater's bag. It will also been seen that the various parts of the sharpener, for example the grinding wheel 26 and dresser member 42, may readily be interchanged with components of different sizes to render the sharpeners suitable for use with different kinds of skate blade.

The hand-held sharpener is also very safe to operate. In this respect, if desired, the right hand end of the body 12 may be at least partly closed to increase the safety of the sharpener.

Other embodiments of the invention will thus be readily apparent to a person skilled in the art, the scope of the invention being defined in the appended claims.

What we claim as new and desire to protect by Letters Patent of the United States is:

1. A portable skate sharpener comprising an elongated hollow main body, an electric motor, said electric motor having a manually grippable housing secured to one end of the main body and an output shaft projecting from the housing and extending in a longitudinal direction in the main body, and a grinding wheel mounted on said shaft for rotation in a plane perpendicular to the longitudinal axis to the main body, said main body extending beyond the grinding wheel in a direction away from the electric motor to provide a manually grippable main body portion on the opposite side of the grinding wheel to the manually grippable motor housing, said main body having an aperture extending in a direction perpendicular to said longitudinal direction below the grinding wheel for receiving an upper edge of an upturned skate blade to enable a skate to be sharpened when held in an inverted position by holding the motor housing with one hand and holding the main body portion with another hand and, while the motor is operating to rotate the grinding wheel, manually moving the sharpener in a direction transverse to its length with the skate blade edge in the aperture in the main body and in engagement with the grinding wheel, the main body carrying means for dressing the grinding wheel at a position above the grinding wheel, said dressing means comprising a plunger projecting into the main body above the grinding wheel and carrying a dresser member at its lower end, said plunger normally being resiliently urged upwardly to an inoperative position and having an upwardly projecting end manually engageable to move the plunger downwardly to cause the dresser member to engage and dress the grinding wheel while the grinding wheel is being rotated by the electric wheel.

2. A skate sharpener according to claim 1 wherein the electric motor is eccentrically mounted in the main body to position the grinding wheel nearer the skate blade receiving aperture.

3. A skate sharpener according to claim 1 wherein the grinding wheel has an outwardly curved peripheral grinding surface, and the dresser member has a complementary inwardly curved dressing surface to enable a skate blade to be hollow ground.

4. A skate sharpener according to claim 1 wherein the aperture in the hollow main body has an elongated dumb-bell shape.

* * * * *